United States Patent [19]

de Feudis

[11] 3,980,166

[45] Sept. 14, 1976

[54] DEVICE FOR DUMPING CHUTE

[75] Inventor: Sergio de Feudis, Nacka, Sweden

[73] Assignee: Aktiebolaget Svenska Flaktfabriken, Stockholm, Sweden

[22] Filed: Aug. 11, 1975

[21] Appl. No.: 603,364

Related U.S. Application Data

[63] Continuation-in-part of Ser. No. 471,388, May 20, 1974, abandoned.

[30] Foreign Application Priority Data

May 21, 1973 Sweden ..... 7307137

[52] U.S. Cl. ..... 193/34; 302/27

[51] Int. Cl.[2] ..... E04F 17/12; B65G 11/00

[58] Field of Search ..... 193/3, 5, 7, 29, 33, 193/34; 302/17, 27, 36; 49/381, 387, 388, 394, 402; 232/44, 45, 46, 47, 48, 19

[56] References Cited

UNITED STATES PATENTS

| | | | |
|---|---|---|---|
| 526,412 | 9/1894 | Poppe | 193/34 X |
| 1,111,016 | 9/1914 | Fohman | 193/34 |
| 1,197,259 | 9/1916 | Brown | 193/34 X |
| 1,586,505 | 5/1926 | Beaver | 193/34 |
| 3,490,813 | 1/1970 | Hallstrom | 302/27 X |

FOREIGN PATENTS OR APPLICATIONS

| | | | |
|---|---|---|---|
| 764,101 | 5/1934 | France | 193/34 |
| 802,228 | 8/1936 | France | 193/34 |
| 243,344 | 2/1911 | Germany | 193/34 |
| 1,084,661 | 9/1967 | United Kingdom | 193/34 |
| 1,084,689 | 9/1967 | United Kingdom | 302/27 |

*Primary Examiner*—John J. Love
*Assistant Examiner*—James L. Rowland

[57] ABSTRACT

A dumping chute is provided with a gate for blocking the outlet from the chute to a shaftway designed to convey dumped goods, such as laundry. The gate is pivotally mounted on a horizontal axis at its upper end so as normally to close the outlet, and to swing into the shaftway to open the outlet when pushed by a bag of dumped goods; the gate being provided at its lower end with a device to lock it in the closed position.

5 Claims, 2 Drawing Figures

DEVICE FOR DUMPING CHUTE

Figure 1:
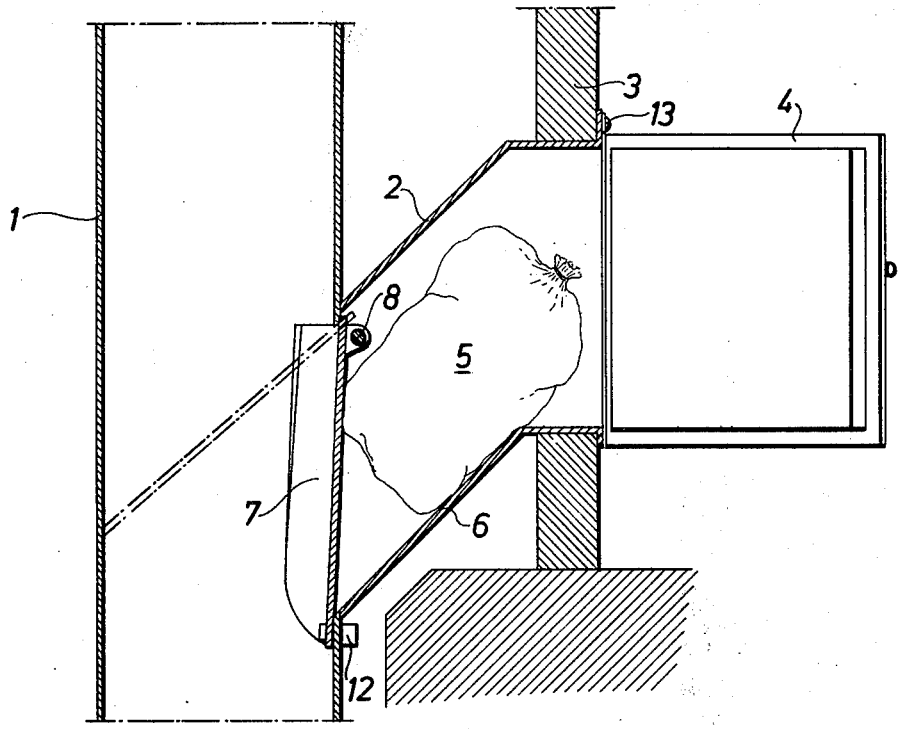

This application is a continuation-in-part of the prior U.S. patent application Ser. No. 471,388, abandoned, filed May 20, 1974 for "DEVICE FOR DUMPING CHUTE."

The present invention refers to a device particularly useful for operation with dumping chutes that are used for instance in connection with chute installations for refuse or laundry and slope into a substantially vertical shaft.

The device according to the invention is intended to be used in particular in connection with installations for collecting and conveying waste materials, such as refuse and dirty linen. Such installations are generally combined with a pneumatic conveying plant for mechanizing transports in large buildings, such as department stores, multi-storey blocks, hospitals, etc. In installations as described, the dumping chutes open into chute shafts reaching through several storeys of the building, each shaft at its lower end incorporating a storage section or bulge for the refuse and opening into a horizontal main duct through which conveyance is effected by fans. The device according to the invention can also be used in connection with dumping chutes for shafts of the conventional type with a container for the dumped goods below the shaft outlet.

Experience has shown that in conventional installations the bags of dumped goods have a tendency to tumble when during their fall they pass a chute outlet further down. The bag of goods will then strike the lower aspect of the dumping chute and may be caught in the shaft. The dumped goods following next will thus be intercepted by the bag which is caught, which protrudes obliquely from the chute, with an ensuing obstruction of the entire length of shaft above the chute concerned. The reason why the bag becomes caught in an oblique position may be that the air cushion formed underneath the falling bag is first caught by the dumping chute, causing the bag to follow in the direction of the least air resistance.

It is the primary purpose of the present invention to eliminate the above-mentioned disadvantage, i.e., to prevent the dumped goods from being caught in the shaft at the dumping chute outlets. It is also a purpose of the invention to prevent the occurrence of bodily injuries in connection with entering the said goods into the dumping chute.

The first-mentioned object is achieved according to the invention mainly by fitting the dumping chute with a gate at the end opening into the shaft, the said gate being pivoted at its upper margin on a substantially horizontal axle and closing the chute outlet when at rest, the lower part of the gate swinging into the shaft cavity when being subjected to the impetus of the goods passing through the dumping chute into the vertical shaft.

The elimination of bodily injuries is realized mainly by a locking mechanism at the lower margin of the gate being actuated by a control fitted at the chute door, causing the gate to be locked in the closed position and enabling the dumped goods to enter the shaft only upon disengagement of the said locking mechanism.

Figure 2:
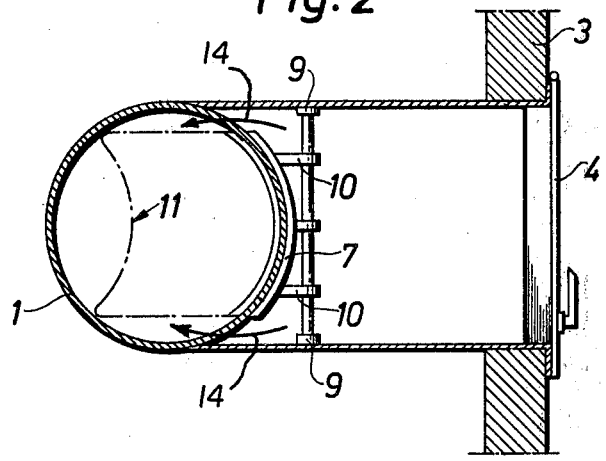

One design of the present invention selected as an example is described below, reference being made to the appended drawing in which FIG. 1 illustrates a vertical section through a dumping chute and part of the adjoining dumping shaft in which a gate according to the invention has been fitted, and FIG. 2 illustrates a horizontal section through a dumping shaft and an adjoining dumping chute in accordance with FIG. 1.

According to FIG. 1 a vertical dumping shaft 1 is provided for refuse or laundry that is entered into the shaft by a dumping chute 2 built into a wall 3 and fitted with a door 4 for closing the chute. A bag 5 for refuse or dirty linen, when dumped into the chute, will slide along the lower surface 6 of the chute and, when reaching a certain position, will strike upon a gate 7 at the end of the chute that opens into the shaft 1. The gate 7 is pivoted at its upper margin on a horizontal axle 8 the ends of which rest in supports 9 that are firmly fixed to the chute 2. The shape of the gate 7 coincides in the main with the inner wall of the shaft 1; the attachment of the gate to the axle 8 is by braces 10 or similar adequate means.

To achieve an efficient closure of the chute outlet by the gate 7, thus preventing goods falling through the shaft from being caught at the said outlet, the upper and lower margins of the gate are designed to overlap the adjacent edges of the structure forming the dumping shaft proper, the upper margin of the gate overlapping the said structure on its outside relative to the shaft and the lower margin overlapping it on the inside. The lower margin of the gate is given a somewhat curved profile 11 in agreement with the curved lower aspect of the dumping chute 6.

An electromagnetically actuated locking device in the form of a pawl 12 at the bottom of the chute outlet engages the lower margin of the gate, locking the gate in its closed position until being disengaged by pressing an electrical control switch button 13 or some similar device on or at the chute-door jamb. The electromagnetic locking of the gate is to preclude the occurrence of bodily injuries when dumping a bag into the chute, which thus cannot be opened towards the shaft until the button is pressed. The gate 7 is then opened by the pressure exerted by the bag 5 and is swung out sufficiently to permit the bag to drop into the shaft. The locking devices for the various chute doors are generally interlocked electromagnetically in such a way as to permit only one door at a time to be opened, thus preventing two or more bags being dumped simultaneously into the chutes, which might result in collisions in the shaft, causing annoying jamming. In cases where the refuse is conveyed from the dumping shaft by pneumatic means the interlocking system also closes a valve for the pneumatic conveyance and a valve at the bottom of the shaft as soon as a chute door is opened.

As previously mentioned above, the structure of the present invention is intended to be used often with a pneumatic conveying arrangement for handling the dumped waste materials at the bottom of the chute 1. This means that the bottom of the chute is constantly under suction. It is another important feature of the invention, not previously emphasized above, that the gate 7 is substantially narrower than the opening of the chute 2 into the shaft 1. Thus, as indicated by the arrows 14 in FIG. 2, substantial passages exist for air communication from the chute 2 around the sides of the gate 7 into the shaft 1 to permit free movement of contaminated air into the shaft, even when the gate 7 is in the closed position. This assures that any air movement due to leakage at the door 4, or due to the opening of door 4, is moved from the chute into the shaft 1. This prevents any contaminated air from moving out of the disposal system. This is believed to be important for both esthetic and health reasons, since the air may be contaminated with odors, or with airborne bacteria.

I claim:

1. In combination in a vertical dumping shaft structure with a dumping chute, such as a refuse or laundry chute, directed obliquely downward and having an outlet opening into a substantially vertical dumping shaft, the improvement comprising a gate at the end of said chute outlet opening into the dumping shaft, the said gate being pivoted at its upper margin on a substantially horizontal axis so as to close the chute outlet when at rest, the lower part of the gate being operable to swing out into said shaft to open in response to the force of dumped goods in the chute to thereby cause the dumped goods to enter the dumping shaft, said gate forming part of the inner wall surface of the shaft and the shape of said gate on the side facing said dumping shaft substantially coinciding with the shape of the inside of said dumping shaft, the upper and lower margins of said gate overlapping the adjacent edges of the structure forming said dumping shaft when said gate is in the closed position, the upper margin of said gate overlapping said structure on the outside relative to the shaft and the lower margin overlapping said structure on the inside of said shaft to thereby avoid upward facing abruptly protruding marginal edges at said gate so that the combination of the walls of said shaft and the inner surface of said gate serve to convey dumped goods smoothly past said gate, said gate being substantially narrower than said opening of said chute into said dumping shaft to thereby provide air communication for free movement of contaminated air from said chute into said shaft.

2. The combination as claimed in claim 1, including a locking mechanism at the lower margin of said gate to lock said gate in the closed position, and means arranged at the inlet of said dumping chute and operable for disengagement actuation of said locking mechanism to permit said gate to open to thereby permit dumped goods to enter the shaft.

3. The combination as claimed in claim 2 wherein said locking mechanism comprises an electromagnetically actuated locking device and said means operable for disengagement actuation of said locking device comprises an electrical control switch for controlling an electric current supply to said electromagnetically actuated locking device.

4. The combination as claimed in claim 3 wherein said electromagnetically actuated locking device comprises an electromagnetically actuated pawl.

5. The combination as claimed in claim 3 wherein a plurality of dumping chutes are provided in combination with said vertical dumping shaft structure and all of said dumping chutes are provided with gates having electromagnetically actuated locking mechanisms, the locking mechanisms for all of said chute gates being interlocked to prevent the unlocking of more than one gate at a time.

* * * * *